US008597161B2

(12) United States Patent
Dibble et al.

(10) Patent No.: US 8,597,161 B2
(45) Date of Patent: Dec. 3, 2013

(54) MOTORLESS TREADMILL STEPPER EXERCISE DEVICE

(75) Inventors: Ryan R. Dibble, Camas, WA (US); Bryce C. Baker, Battle Ground, WA (US); Marcus L. Marjama, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 436 days.

(21) Appl. No.: 12/854,123

(22) Filed: Aug. 10, 2010

(65) Prior Publication Data

US 2012/0040802 A1 Feb. 16, 2012

(51) Int. Cl.
*A63B 22/02* (2006.01)
*A63B 22/04* (2006.01)

(52) U.S. Cl.
USPC ..... 482/52; 482/54

(58) Field of Classification Search
USPC ..... 482/51–54, 70, 71, 74, 79, 80
See application file for complete search history.

(56) References Cited

U.S. PATENT DOCUMENTS

| | | | | |
|---|---|---|---|---|
| 5,336,146 | A | 8/1994 | Piaget et al. | |
| 5,626,539 | A | 5/1997 | Piaget et al. | |
| 5,669,856 | A * | 9/1997 | Liu | 482/51 |
| D406,621 | S | 3/1999 | Piaget | |
| D421,779 | S | 3/2000 | Piaget et al. | |
| 6,461,279 | B1 | 10/2002 | Kuo | |
| 6,811,517 | B1 * | 11/2004 | Eschenbach | 482/52 |
| D527,060 | S | 8/2006 | Flick et al. | |
| 7,097,593 | B2 | 8/2006 | Chang | |
| D534,973 | S | 1/2007 | Flick et al. | |
| 7,517,303 | B2 | 4/2009 | Crawford et al. | |
| 7,553,260 | B2 | 6/2009 | Paiget et al. | |
| 7,618,346 | B2 | 11/2009 | Crawford et al. | |
| 7,621,850 | B2 | 11/2009 | Piaget et al. | |
| 7,645,214 | B2 | 1/2010 | Lull | |
| 7,704,191 | B2 | 4/2010 | Smith et al. | |
| 7,731,636 | B2 | 6/2010 | Lull et al. | |
| D624,975 | S | 10/2010 | Flick et al. | |
| 7,811,209 | B2 | 10/2010 | Crawford et al. | |
| 7,815,549 | B2 | 10/2010 | Crawford et al. | |
| 7,819,779 | B2 | 10/2010 | Chang | |
| 2009/0029831 | A1 | 1/2009 | Weier | |
| 2009/0264260 | A1 | 10/2009 | Piaget et al. | |
| 2010/0062904 | A1 | 3/2010 | Crawford et al. | |
| 2010/0075812 | A1 | 3/2010 | Piaget et al. | |

FOREIGN PATENT DOCUMENTS

| | | | |
|---|---|---|---|
| KR | 2009120109 A | * | 11/2009 |
| WO | WO 95/16502 | | 6/1995 |
| WO | WO 2004/078270 | | 9/2004 |
| WO | WO 2004/078271 | | 9/2004 |
| WO | WO 2004/078272 | | 9/2004 |
| WO | WO 2005/014117 | | 2/2005 |
| WO | WO 2005/082100 | | 9/2005 |
| WO | WO 2005/082105 | | 9/2005 |
| WO | WO 2005/082113 | | 9/2005 |
| WO | WO 2005/082114 | | 9/2005 |

* cited by examiner

*Primary Examiner* — Oren Ginsberg
(74) *Attorney, Agent, or Firm* — Klarquist Sparkman, LLP

(57) ABSTRACT

An exercise device can include a frame, first and second treadle assemblies, and a one-way drive system. Each treadle assembly can include a deck and tread belt rotatably coupled to the deck. The treadle assemblies can be pivotably mounted to the frame. Downward movement of the two treadle assemblies can cause the tread belts associated with the treadle assemblies to rotate relative to their decks.

20 Claims, 12 Drawing Sheets

MOTORLESS TREADMILL STEPPER EXERCISE DEVICE

FIELD

The present disclosure relates to exercise equipment and, more particularly, to treadmill stepper exercise equipment that combines features of treadmills and stair climbing exercise machines.

BACKGROUND

Conventional treadmills provide a platform with a moving belt on which a user can walk or run in place. Most conventional treadmills have a motor that drives the belt over the platform. Some conventional treadmills are motorless, but have the platform set at a fixed angle or slope so that with each step the user's weight pushes the belt down along the platform. A flywheel may be coupled to the belt to maintain the belt motion that is generated by the user with each step.

Conventional stair climbing exercise machines (also called steppers) generally have two pedals that a user alternately steps against to simulate stair climbing. Devices that combine the stair climbing aspect of steppers with the moving belt of a treadmill have also been developed. For example, U.S. Pat. No. 7,097,593, assigned to Nautilus, Inc., discloses a combination treadmill/stepper. Like conventional treadmills, however, conventional combination treadmill/steppers, such as the device disclosed in U.S. Pat. No. 7,097,593, are motor-driven so that the speed of the moving belts and/or the stepping action can be more accurately controlled.

SUMMARY

In one embodiment, an exercise device comprises a frame, first and second treadle assemblies, a drive shaft, and a rotational coupling between the drive shaft and the tread belts so that the rotational motion of the drive shaft provides rotational motion of the tread belts. The first and second treadle assemblies each include a deck and an endless tread belt rotatably mounted to pass over the deck. Each treadle assembly is pivotably mounted to the frame to pivot between upward and downward positions. The drive shaft is operably coupled to the first and second treadle assemblies by a one-way drive system through which pivotal motion of the first and second treadle assemblies provides rotational motion to the drive shaft.

In some embodiments, the one-way drive system includes a first drive member coupled to the first treadle assembly and positioned to contact a first one-way engagement member to rotate the drive shaft in a first direction when the first treadle assembly moves between the upward and downward positions, and a second drive member coupled to the second treadle assembly and positioned to contact a second one-way engagement member to rotate the drive shaft in the first direction when the second treadle assembly moves between the upward and downward positions.

In some embodiments, the first and second engagement members are configured to disengage from the drive shaft when the respective first and second treadle assemblies return from the movement that rotates the drive shaft in the first direction. The first drive member can include a first linkage arm and the first engagement member can include a first one-way clutch bearing coupled to the first linkage arm, and the second drive member can include a second linkage arm and the second engagement member can include a second one-way clutch bearing coupled to the second linkage arm. In other embodiments, the first drive member can include a first roller and the first engagement member can include a first cam that is driven by the first roller, and the second drive member can include a second roller and the second engagement member can include a second cam that is driven by the second roller. Both first and second cams can be mounted on respective one-way clutch bearings so that the movement of the first and second treadle assemblies from the downward position to the upward position causes the first and second cams to pivot back toward the respective first and second rollers. In some embodiments, the rotational coupling between the drive shaft and the tread belts includes a roller shaft extending across a back portion of the first and second treadle assemblies to drive rotational motion of the tread belt of the first and second treadle assemblies. In some embodiments, the rotational coupling can include a step-up gearing mechanism to provide stepped-up gearing between rotational motion of the drive shaft and the roller shaft.

In other embodiments, a return assembly can be provided. The return assembly can link the first and second treadle assemblies such that movement of either of the first and second treadle assemblies from the upward position to the downward position causes the other of the first and second treadle assemblies to move from the downward position to the upward position. In other embodiments, the decks of the first and second treadle assembles can each have a length and the first and second treadle assemblies can be pivotable between a maximum pivot angle and a minimum pivot angle. Movement of either treadle assembly between the maximum pivot angle and the minimum pivot angle can cause the tread belts of the first and second treadle assemblies to move a distance that is less than the length of the decks.

In another embodiment, an exercise device can comprise a frame, left and right treadle assemblies, a roller, and a motorless drive system. The left treadle assembly can have a left deck and an endless left tread belt rotatably mounted to pass over the left deck. The left treadle assembly can be pivotally mounted to the frame. The right treadle assembly can have a right deck and an endless right tread belt rotatably mounted to pass over the right deck. The right treadle assembly can also be pivotally mounted to the frame. The roller can extend across a rear portion of both the left and right treadle assemblies and within the left and right tread belts to rotate them. The motorless drive system is configured to drive the roller during pivotal motion of the left and right treadle assemblies.

In some embodiments, the left and right treadle assemblies are pivotable between an upward position and a downward position to provide a downward stroke, and the motorless drive system is powered by the downward movement of the left and right treadle assemblies during the downward stroke of the left and right treadle assemblies. In some embodiments, the roller can drive the right and left tread belts at the same speed. In some embodiments, a pair of external bearing members can be positioned on the roller between the left and right treadle assemblies. In other embodiments, a drive shaft can be positioned below the left and right treadle assemblies and a rotational coupling can be provided between the drive shaft and the roller. The motorless drive system can include a left drive member and a right drive member, with the left drive member being coupled to and extending below the left treadle assembly and the right drive member being coupled to and extending below the right treadle assembly. The left and right drive members can engage the drive shaft during pivotal motion of the left and right treadle assemblies to provide to the drive shaft rotational motion that is imparted to the roller via the rotational coupling.

In some embodiments, a return assembly can be provided that links the left and right treadle assemblies such that the left and right treadle assemblies move in opposite pivotal directions and the left and right drive members alternately engage the drive shaft. The left and right drive members can comprise linkage arms or rollers. In some embodiments, a left one-way clutch bearing and a right one-way clutch bearing can be provided, with the left drive member providing a downward force on the left one-way clutch bearing to engage the drive shaft during a downward stroke of the left treadle assembly and the right drive member providing a downward force on the right one-way clutch bearing to engage the drive shaft during a downward stroke of the right treadle assembly.

In another embodiment, an exercise device comprises a frame, first and second treadle assemblies, and a motorless drive system. First and second treadle assemblies can each include a deck and an endless tread belt extending around the treadle assembly and passing over the deck. Each treadle assembly can be pivotably mounted to the frame such that each treadle assembly can alternately pivot upwards and downwards. The motorless drive system can be driven by the respective downward movements of the first and second treadle assemblies from upward positions to downward positions to rotate the tread belts around the treadle assemblies.

In some embodiments, a return assembly can be provided. The return assembly can link the left and right treadle assemblies such the left and right treadle assemblies move in alternating directions. The motorless drive system can include a first one-way drive member associated with the first treadle assembly and a second one-way drive member associated with the second treadle assembly. The first and second one-way drive members can be configured to alternately engage to rotate the tread belts of the first and second treadle assemblies.

In some embodiments, a drive shaft and a rotational coupling between the drive shaft and the tread belts can be provided so that the rotational motion of the drive shaft provides rotational motion of the tread belts. The first and second one-way drive members can engage the drive shaft to rotate it and thereby to provide rotation to the tread belts via the rotational coupling.

In another embodiment, a method of exercising is provided. The method includes pivoting a first treadle assembly between an up position and a down position and pivoting a second treadle assembly between an up position and a down position. A tread belt rotatably coupled to a deck of each of the respective first and second treadle assemblies can be driven by exerting a user-directed force to the first and second treadle assemblies as each respective treadle assembly moves from the up position to the down position. The user-directed force comprises a first component that directly rotates the respective tread belts of the first and second treadle assemblies and a second, downwardly directed component that drives a one-way drive system that causes the tread belts to rotate about their respective decks.

In some embodiments, the first and second treadle assemblies can pivot in a reciprocating manner. In other embodiments, the driving of the one-way drive system can include moving a drive member to engage a one-way engagement member that transmits a rotational force to the tread belts. The tread belts of the first and second treadle assembly can be driven at the same speed.

The foregoing and other objects, features, and advantages of the invention will become more apparent from the following detailed description, which proceeds with reference to the accompanying figures.

DETAILED DESCRIPTION

The following description is exemplary in nature and is not intended to limit the scope, applicability, or configuration of the disclosed embodiment in any way. Various changes to the disclosed embodiments may be made in the function and arrangement of the elements described herein without departing from the scope of the invention.

As used in this application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

As used herein, the terms "front," "rear," "right," and "left," "upper," and "lower" refer to relative directions from the perspective of a user standing on the exercise device in a forward facing manner as the device is typically used.

Figure 1:
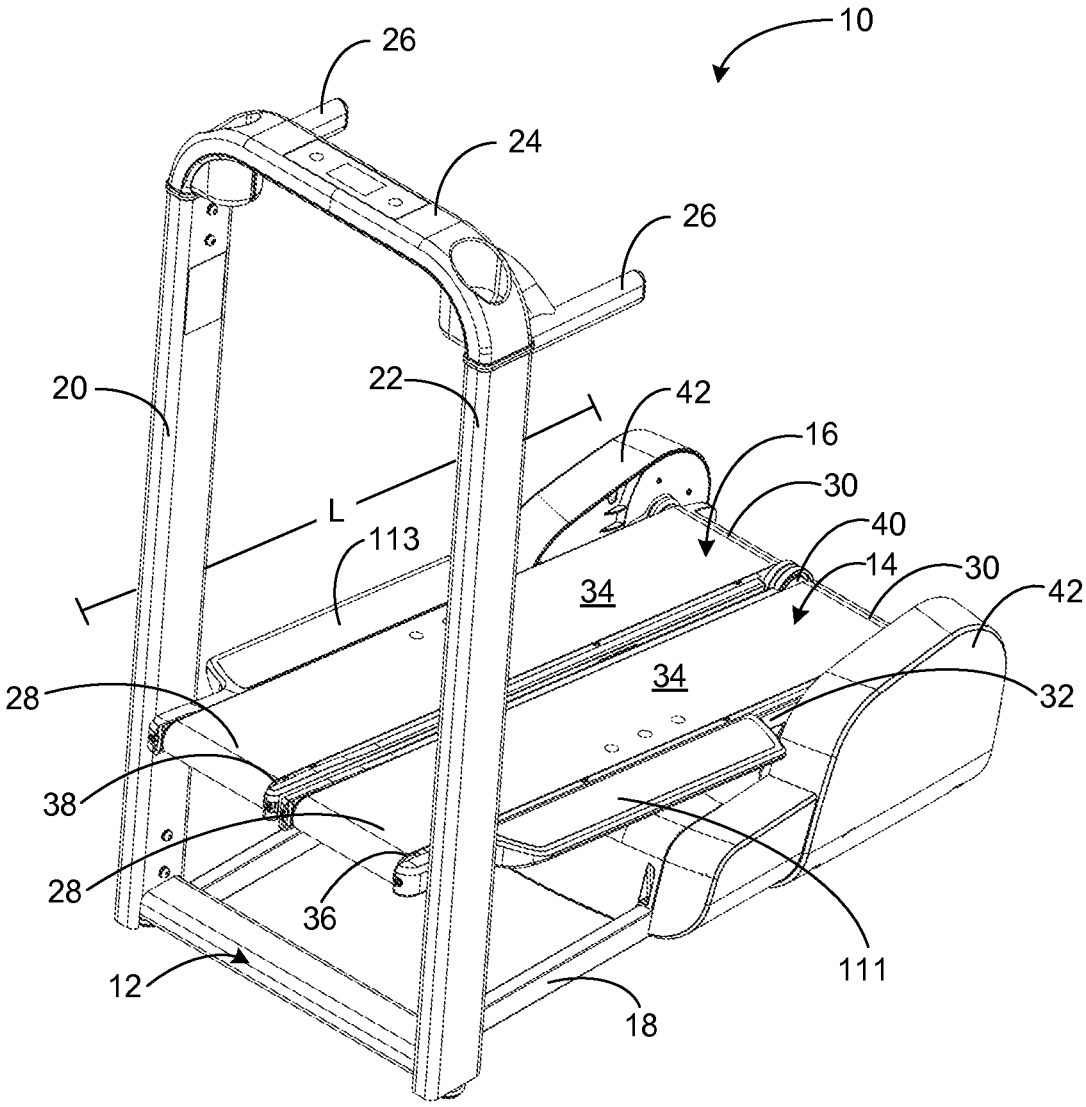
FIG. 1 is a perspective view of an embodiment of an exercise device.

FIG. 1 illustrates a motorless treadmill stepper exercise device 10 that can simultaneously provide a user with exercise that simulates both stepping/climbing and walking/running. Device 10 includes a frame 12 to which a left treadle assembly 14 and a right treadle assembly 16 are pivotably coupled. Frame 12 includes a frame base 18 and two generally upright posts 20, 22. Posts 20, 22 are coupled together via a crossbar 24 extending therebetween. Handle members 26 are coupled to crossbar 24 or posts 20, 22, to provide gripping surfaces for one or both hands of a user during use of device 10. Alternatively, a user could grip crossbar 24. For example, handle members 26 can assist the user in mounting, dismounting, and/or maintaining balance while operating device 10. In addition, other features or accessories can be provided on, incorporated into, or coupled to crossbar 24 or posts 20, 22 to enhance the user experience, including, for example, one or more each of drink holders, book or magazine supports, and display screens for displaying relevant information to the user about the exercise session and/or operation of device 10 (e.g., exercise duration, estimated calories expended by the user, level of difficulty, etc.).

Each treadle assembly 14, 16 has a front portion 28 and a rear portion 30 and includes as a top surface a deck 32 that supports a tread belt 34. Tread belts 34 are continuous belts that each travel in a circuit around the length of its treadle assembly 14, 16 in an endless loop. In operation, the treadle assemblies 14, 16 pivot up and down in alternation while their respective tread belts 34 are rotated to pass over their decks 34 to provide a moving treadmill-type surface for each foot.

Treadle assemblies 14, 16 include respective front rollers 36, 38 and a common rear roller 40. Each tread belt 34 extends over its respective front roller 36, 38 and rear roller 40. As will be described in more detail below, rear roller 40 can be a single integrated roller, or otherwise two separate rollers that are fixed relative to one another, to provide a uniform speed for both tread belts 34. Exercise device 10 can have one or more panels 42 (FIG. 1 only) that cover and protect the various moving parts of exercise device 10, as well as protecting the user and providing a decorative appearance.

Figure 2:
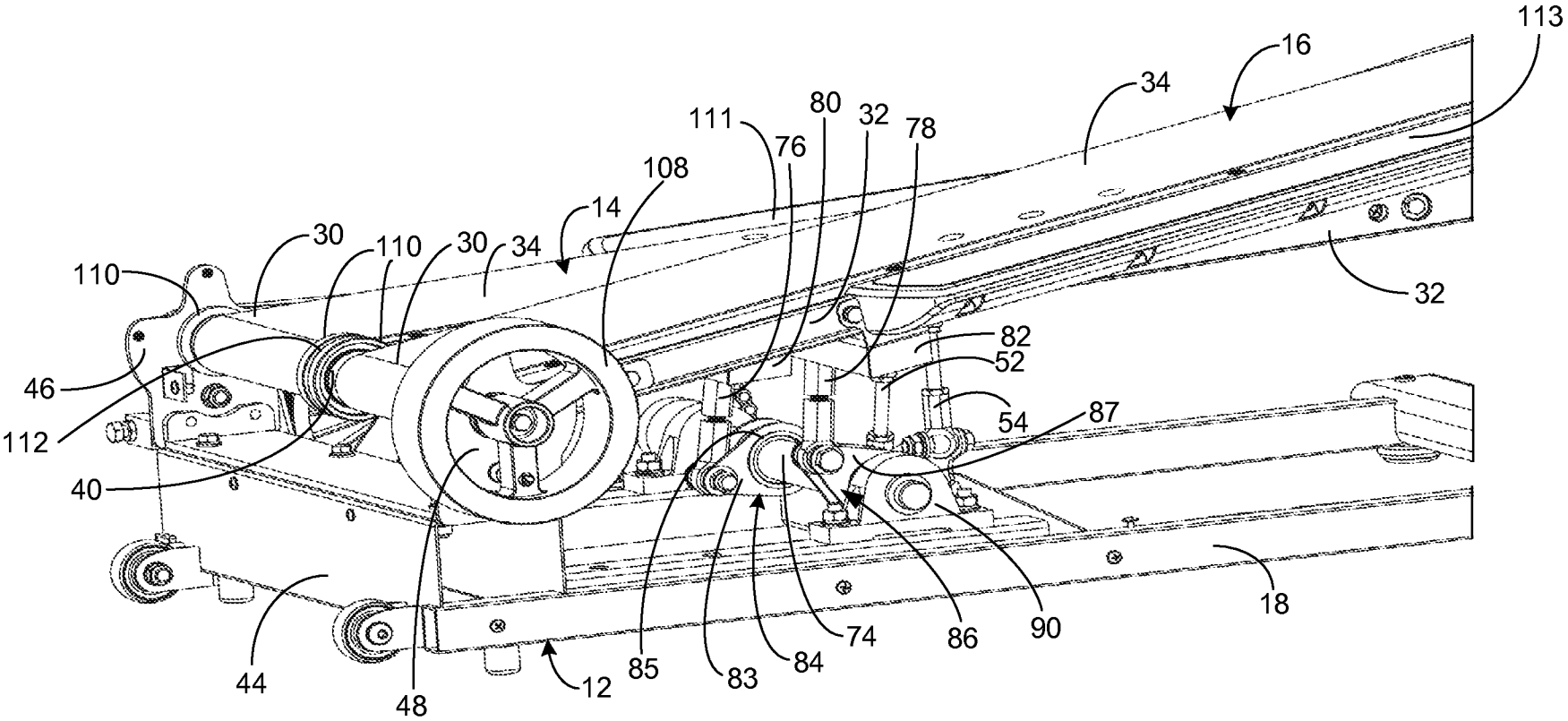
FIG. 2 is a perspective view of a rear portion of the exercise device of FIG. 1, shown with various elements removed for clarity.
Figure 3:
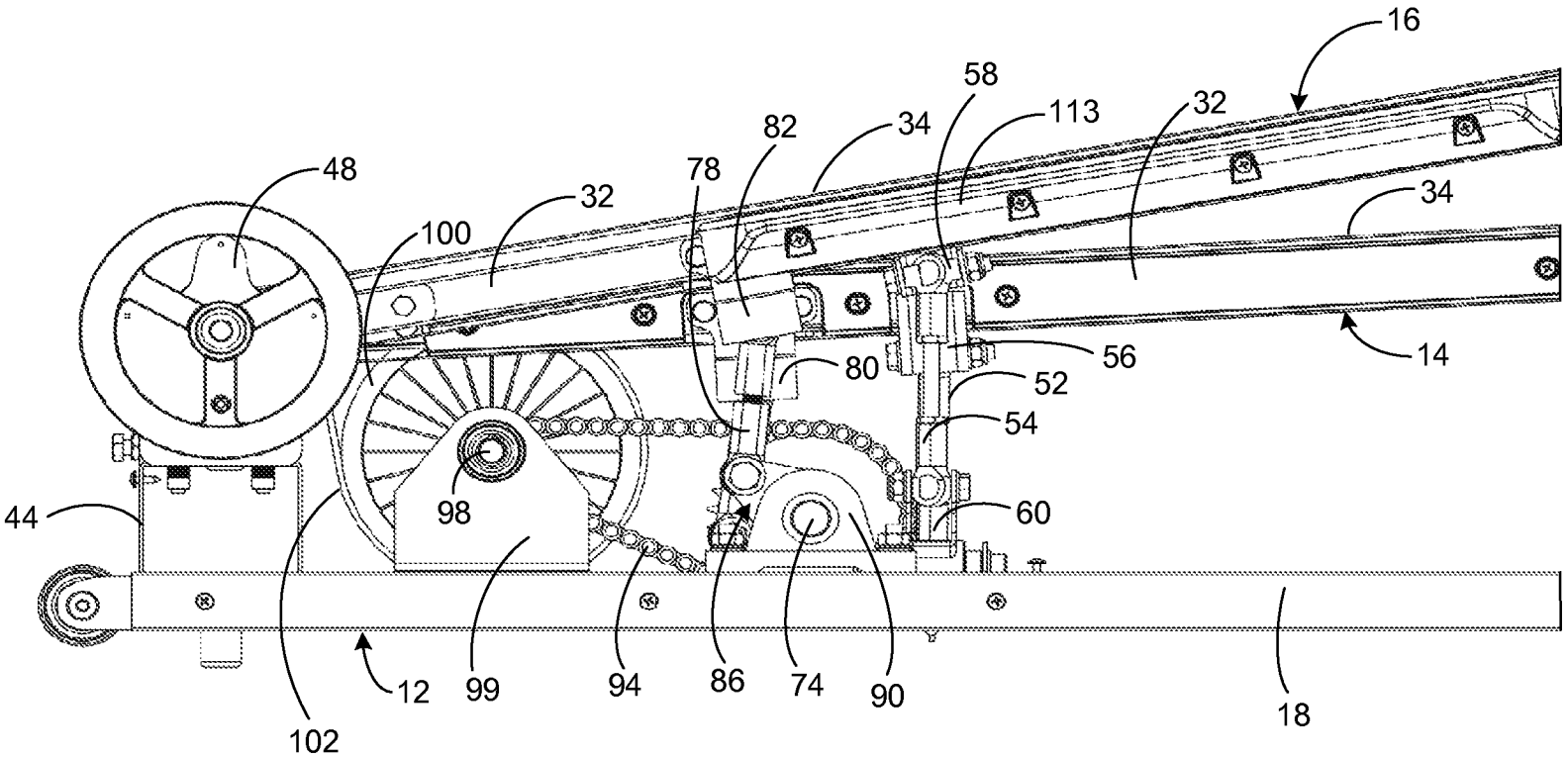
FIG. 3 is a right side view of a rear portion of the exercise device of FIG. 1, shown with various elements removed for clarity.

As shown in FIGS. 2 and 3, treadle assemblies 14, 16 are pivotably coupled to a rear base portion 44 of frame 12 at or near the rear portion 30 of each treadle assembly. As shown in FIG. 2, for example, left and right extensions 46, 48 (e.g., left and right brackets) are coupled to rear base portion 44 and extend upward and receive and support therebetween rear roller 40. For example, ring bearings can be fitted into extensions 46, 48 or into outer treadle support brackets, or both, to support reduced-diameter portions of rear roller 40.

A shaft extension 106 (FIG. 4) is rotatably supported by left extending member 46 and is fixed relative to rear roller 40. Movement of shaft extension 106 and roller 40 simultaneously drives both tread belts 34 at the same speed. As described in more detail below, exercise device 10 uses the force created by the stepping motion of treadle assemblies 14, 16 to drive shaft extension 106 and simultaneously rotate both tread belts 34. In this manner, a motorless system can be provided that generates sufficient power to drive tread belts 34 to generally achieve the comfort and control of a motor-driven exercise device.

As described above and as shown in FIGS. 1-3, the rear portion 30 of each treadle assembly 14, 16 is pivotally supported at or near the rear of exercise device 10 so that the treadle assemblies may pivot upward and downward. When a user steps on a tread belt 34, the associated treadle assembly 14, 16 (including the belt) will pivot downwardly. Thus, in operation, each treadle assembly can pivot between an upward position in which front portion 28 is pivoted upward and a downward position in which front portion 28 is pivoted downward relative to the upward position. The front portion 28 of one of the treadle assemblies 14, 16 is at a higher height relative to the ground when it is in the upward position than when it is in the downward position. Movement of either treadle assembly 14, 16 from an upward position to a downward position is referred to herein as a downward stroke, and movement of either treadle assembly 14, 16 from a downward position to an upward position is referred to herein as an upward stroke.

A return assembly 50 (FIGS. 5 and 6) returns each treadle assembly 14, 16 to a raised or upward position after that treadle assembly pivots downward. In one embodiment, the return assembly 50 interconnects or links the two treadle assemblies 14, 16 such that downward or upward movement of one treadle assembly causes a respective upward or downward movement of the other treadle assembly. Thus, when the user steps on one tread belt 34, the associated treadle assembly will pivot downwardly while the other treadle assembly will pivot upwardly. With the treadle assemblies 14, 16 thusly configured to move up and down in a reciprocating manner, the device 10 can accurately simulate a stepping or climbing action.

Figure 5:
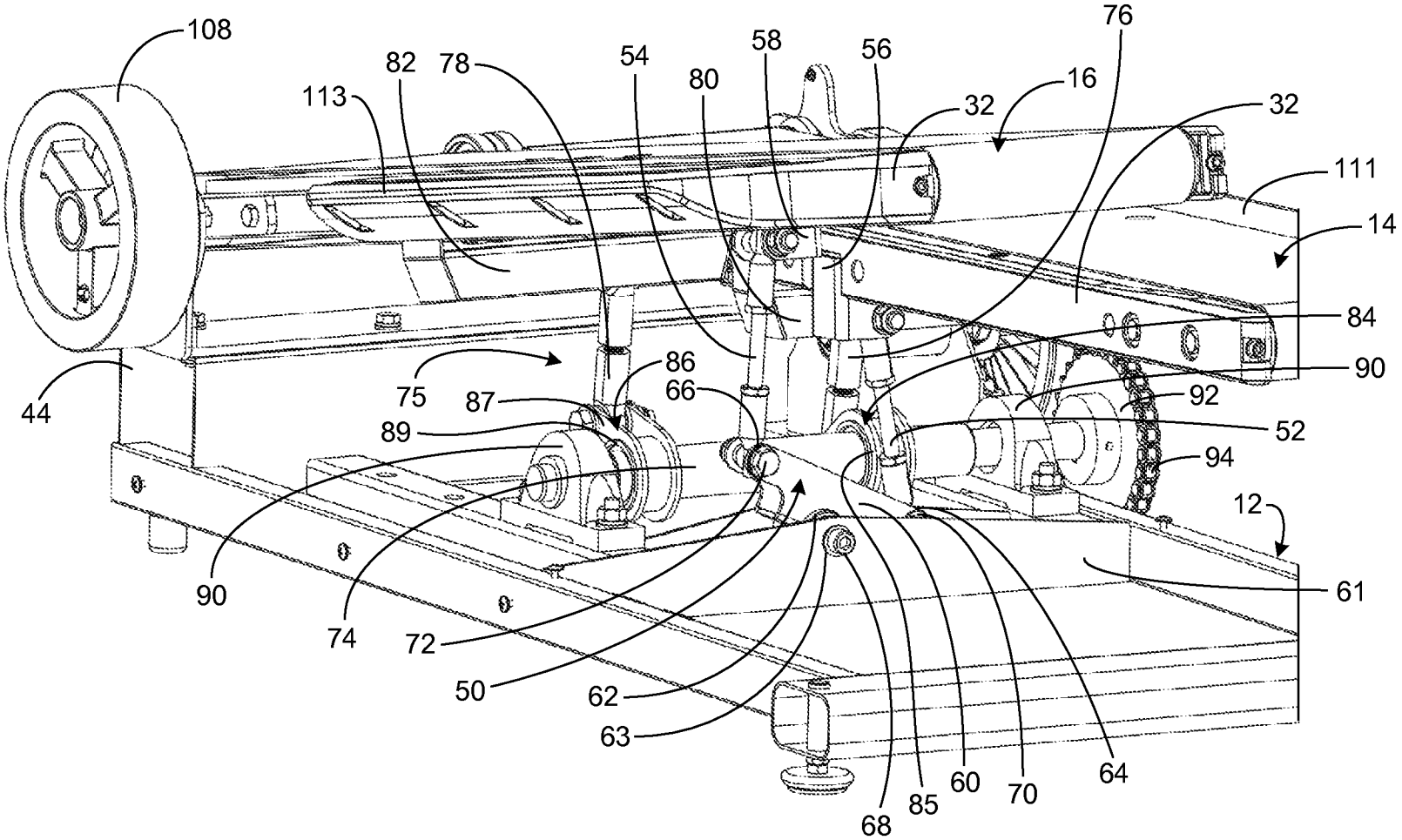
FIG. 5 is a perspective view of a rear portion of the exercise device of FIG. 1, shown with various elements removed for clarity.
Figure 6:
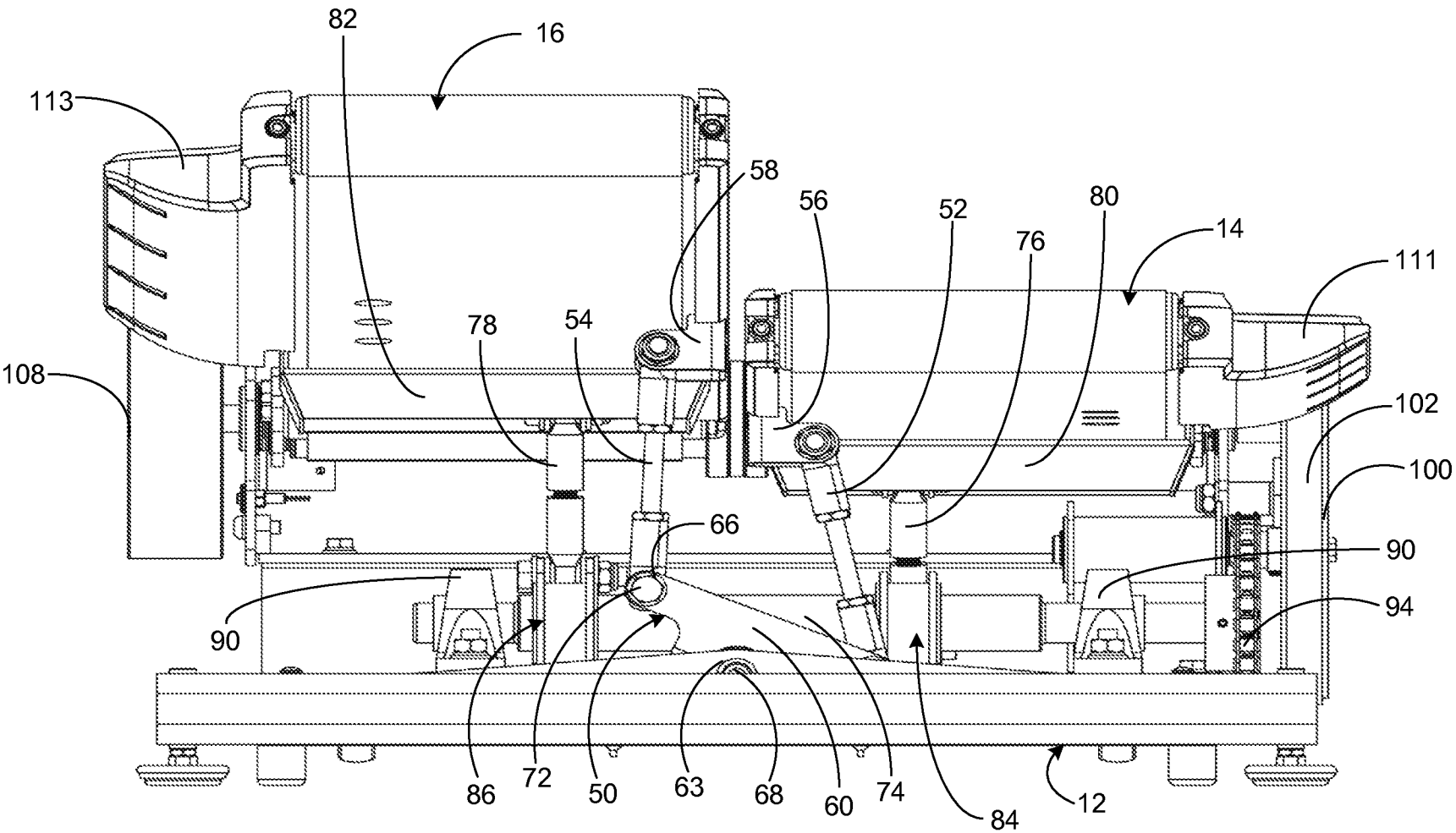
FIG. 6 is a front view of a portion of the exercise device of FIG. 1, shown with various elements removed for clarity and the right treadle assembly in a raised position relative to the left treadle assembly.

FIGS. 5 and 6 illustrate a return assembly 50 that interconnects the two treadle assemblies 14, 16 so that downward motion of one treadle assembly causes a reciprocal upward motion of the other treadle assembly. Return assembly 50 includes a first connecting arm 52 coupled to treadle assembly 14 and a second connecting arm 54 coupled to treadle assembly 16. First and second connecting arms 52, 54 have first ends that are coupled to linking brackets 56, 58 on inner facing sides of treadle assemblies 14, 16, respectively. Linking brackets 56, 58 on inner facing sides of respective treadle assemblies 14, 16 allow belts 34 to rotate past linking brackets 56, 58 without interference. The opposed second ends of first and second arms 52, 54 are coupled to opposing sides of a rocker member 60, which is pivotably mounted to frame 12 at an area generally centrally located between left and right sides of frame 12. For example, as shown in FIG. 5, a central frame cross member 61 can extend across a portion of frame 12 and have a frame aperture 63 for pivotably receiving rocker member 60 as described below.

Rocker member 60 includes a central pivot aperture 62, a first pivot aperture 64 on a first side of central pivot aperture 62, and a second pivot aperture 66 on a second, opposing side of central pivot aperture 62. A central pivot pin 68 extends through central pivot aperture 62 and frame aperture 63 to pivotably couple rocker member 60 to central frame member 61. A first pivot pin 70 extends through first pivot aperture 64 to couple the second end of first arm 52 to rocker member 60.

A second pivot pin 72 extends through second pivot aperture 66 to couple the second end of second arm 54 to rocker member 60.

The return assembly 50 described above can also be referred to herein as interconnection assembly 50 since the rocker member 60 interconnects the left treadle assembly 14 with the right treadle assembly 16. For example, the downward stroke of one treadle assembly (e.g., left treadle assembly 14) pivots rocker member 50 about the central pivot pin 68 to induce an upward stroke in the other treadle assembly (e.g., right treadle assembly 16). Thus, the two treadle assemblies 14, 16 are interconnected in a manner to provide a stepping motion in which the downward movement of one treadle is accompanied by the upward movement of the other treadle, and vice versa, through the alternate pivoting or rocking of rocker member 60.

Thus, treadle assemblies 14, 16 reciprocate in an even manner with the alternating pivoting or rocking rocker member 60 of interconnection assembly 50 to provide a user with a consistent stepping action. However, it should be understood that other interconnection assemblies can be provided. For example, the two treadle assemblies can be linked in any manner that causes a generally reciprocating movement of the two treadle assemblies.

Alternatively, or in addition, the return assembly 50 can include independent (e.g., non-interconnected or non-linked) return members that function to assist the return of each treadle assembly in an upward stroke without regard for the downward stroke of the other treadle assembly. For example, a return spring could be coupled between each treadle assembly and the frame. When a user "steps" from the rear portion of one treadle assembly after its downward stroke, the user generally lifts his foot off of the tread belt and extends his foot forward toward the front portion of that treadle assembly. The return spring can provide an upward force to that treadle assembly during the forward extension of the foot so that the treadle assembly can return to the upward position.

Figure 7:
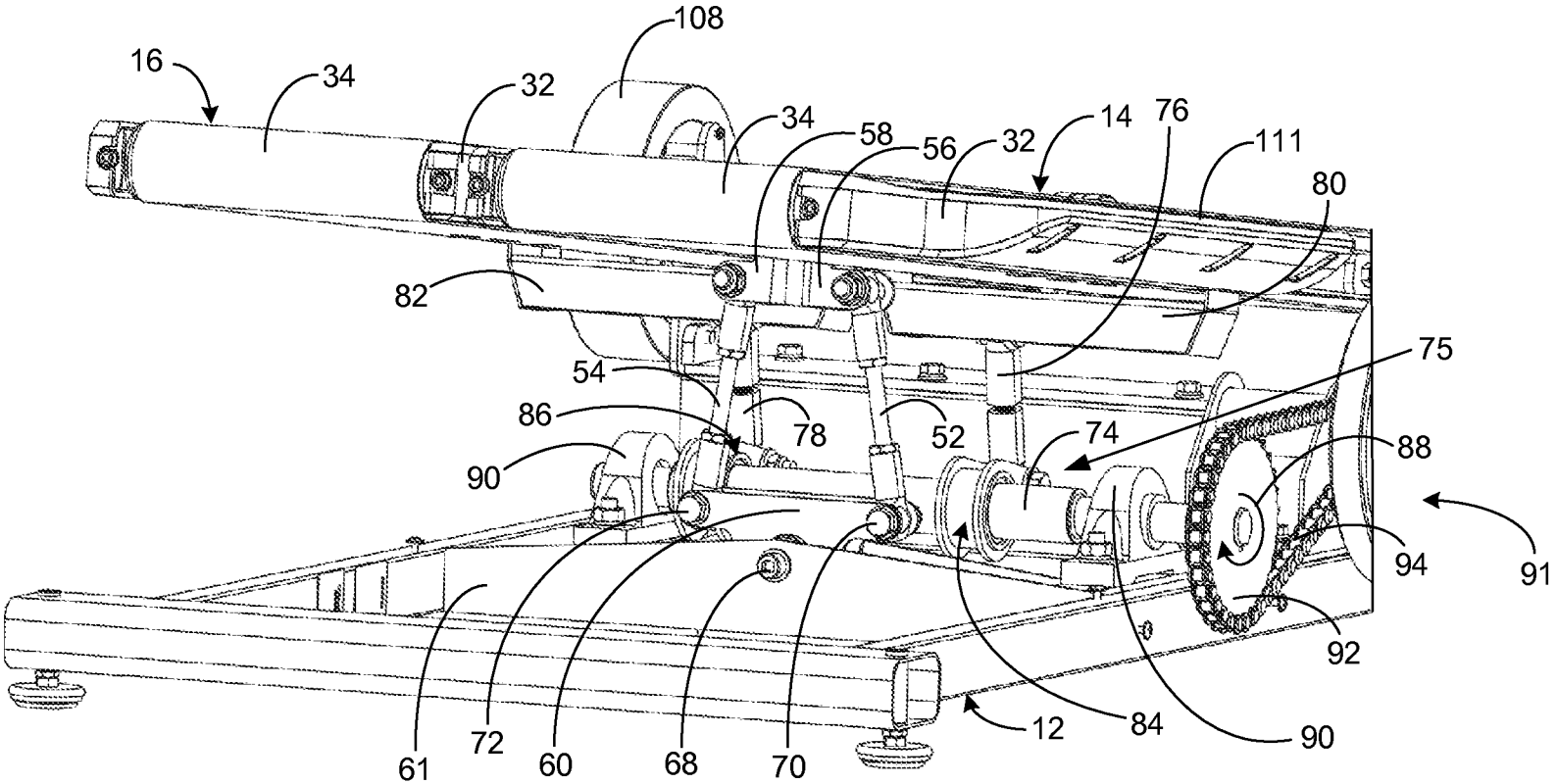
FIG. 7 is a front perspective view of a portion of the exercise device of FIG. 1, shown with various elements removed for clarity.

As discussed above, exercise device 10 can be configured to use the force created by the downward motion of each treadle assembly 14, 16 to drive shaft extension 106 and simultaneously rotate tread belts 34 of the two treadle assemblies 14, 16. FIGS. 5 and 7 illustrate an exemplary one-way drive system 75 for converting energy from the downward strokes of the treadle assembly 14, 16 to drive the tread belts 34.

As shown in FIGS. 5 and 7, each treadle assembly 14, 16 is operatively coupled to a one-way drive system 75 for exerting a rotational force on the tread belts 34 based on the pivoting motion of treadle assemblies 14, 16. In the illustrated embodiment, treadle assemblies 14, 16 are coupled to a drive shaft 74 through drive rods 76 and 78 and one-way engagement members 84 and 86, respectively. The force exerted on the one-way engagement members 84 and 86 by pivoting action of respective treadles 14, 16 rotates drive shaft 74, which in turn drives roller 40 and the two tread belts 34.

As shown in FIG. 7, upper portions of drive rods 76 and 78 are coupled to treadle assemblies 14, 16 at bracket members 80, 82, respectively. Bracket members 80, 82 can be coupled to the respective treadle assemblies 14, 16 in any convenient manner. In the illustrated embodiment, bracket members 80, 82 extend substantially across the width, and are attached to the sides of treadle assemblies 14, 16, respectively.

Lower portions of drive members 76, 78 are coupled to one-way engagement member 84, 86, respectively. In the illustrated embodiment of FIGS. 2, and 5, one-way engagement member 84 includes a linkage arm 83 coupled to a pivoting one-way clutch bearing 85, and one-way engagement member 86 includes a linkage arm 87 coupled to a pivoting one-way clutch bearing 89. The one-way clutch bearings 85, 89 can be any bearing that is operable to engage and drive the drive shaft 74 in one rotational direction while allowing bearings 85, 89 to rotate freely relative to drive shaft 74 in the other rotational direction. Linkage arms 83, 87 position the lower portions of drive members 76, 78 at a radial distance from a longitudinal axis of drive shaft 74 sufficient to provide a torque that imparts a rotational force to drive shaft 74.

Both one-way engagement members 84, 86 successively engage and disengage drive shaft 74 to impart rotational force during one treadle stroke and to return without impeding drive shaft 74 during the opposing treadle stroke. In the illustrated embodiment, one-way engagement members 84, 86 engage and transmit a rotational force on drive shaft 74 to rotate it in a first direction 88 during downward treadle strokes. During upward pedal strokes, one-way engagement members 84, 86 disengage drive shaft 74 and allow it to continue rotating (e.g., freewheeling) in first direction 88 while one-way engagement members 84, 86 return to upward positions. Accordingly, when used in combination with return assembly 50 that links the left and right treadle assemblies 14, 16, drive members 76, 78 alternately engage and drive the drive shaft 74.

It will be appreciated that as an alternative to the illustrated embodiment drive members 76, 78 can alternately engage and drive the drive shaft 74 during upward strokes of treadle assemblies 14, 16. In one implementation of this alternative embodiment, drive shaft 74 could be repositioned so that linkage arms 83, 87 extend rearward and are coupled to respective drive members 76, 78 through rocker mechanisms so that one-way engagement members 84, 86 engage and transmit a rotational force on drive shaft 74 to rotate it in first direction 88 during returning upward treadle strokes.

As shown in FIG. 7, drive shaft 74 is rotatably coupled to frame 12 via one or more fixed bearing members 90. Fixed bearing members 90 include an aperture to receive and support drive shaft 74 in place while allowing drive shaft 74 to rotate relatively freely.

In operation, for each downward stroke of either treadle assembly 14, 16 (e.g., the drop from an upward position to a downward position), tread belts 34 both move along at least a portion of the length L (FIG. 1) of their decks 32. In that manner, the foot of a user who has stepped up onto a front portion of the treadle assembly 14, 16 while it is in an upward position will be transported by the moving tread belt 34 toward the back portion of the treadle assembly 14, 16 by the time it reaches the downward position. In one specific implementation, for each complete downward stroke of either treadle assembly 14, 16 (e.g., the drop from a maximum upward position to a minimum downward position), tread belts 34 both move along the full lengths of their respective decks 32. In other implementations tread belts 34 can move along more or less than the full lengths of their respective decks 32 during a complete downward treadle stroke.

Figure 4:
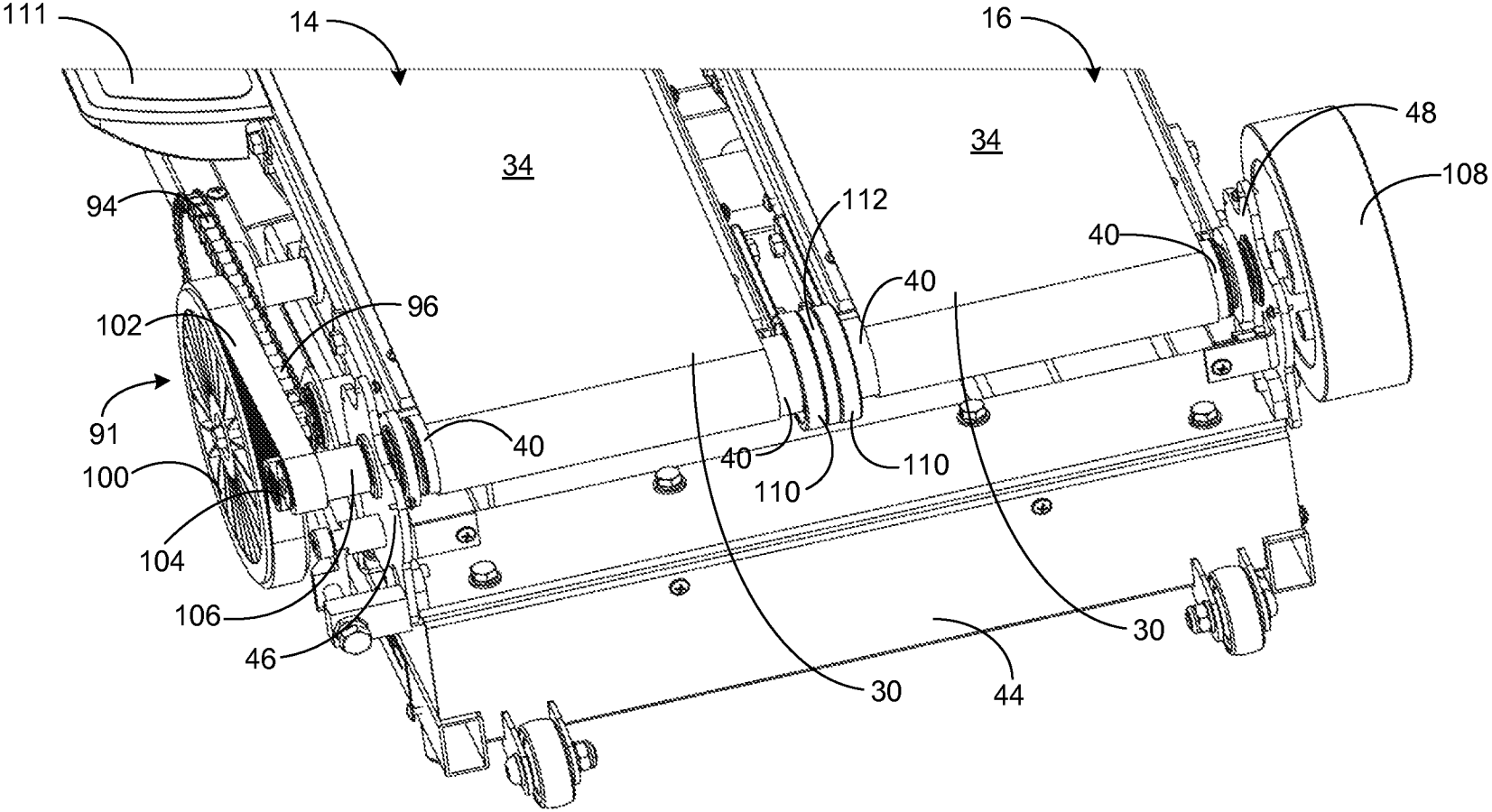
FIG. 4 is a perspective view of a rear portion of the exercise device of FIG. 1, shown with various elements removed for clarity.
Figure 8:
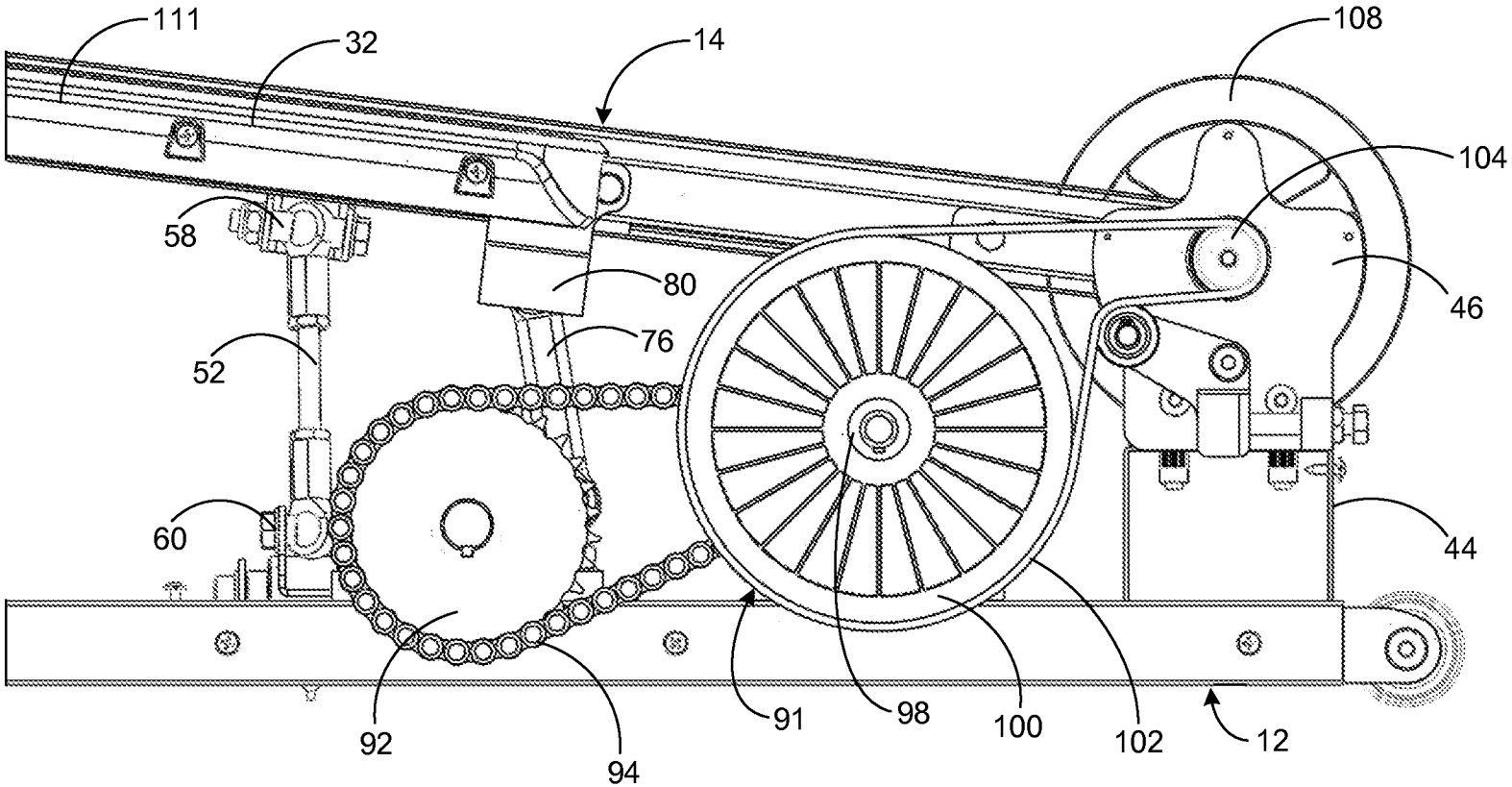
FIG. 8 is a side view of a portion of the exercise device of FIG. 1, shown with various elements removed for clarity.

A step-up gearing mechanism 91 steps-up rotation of drive shaft 74 to provide sufficient rotation of rear roller 40 to pass the tread belts 34 and a user's foot from a desired front portion to a desired rear portion of the treadle assemblies 14,16 during a downward treadle stroke. As illustrated in FIGS. 4 and 8, step-up gearing mechanism 91 includes a sprocket 92 that is coupled to an end of and is driven by drive shaft 74. An endless drive chain 94 extends around sprocket 92 and a small-diameter sprocket 96 that rotates on an intermediate shaft 98 with a large-diameter pulley 100. As drive chain 94 rotates about and drives sprocket 92, small-diameter sprocket 96 rotates at a higher rotational velocity than drive shaft 74, thereby providing a first step-up in the rotational motion of drive shaft 74. Intermediate shaft 98 is supported by an upwardly extending support member 99 (FIG. 3). An endless belt 102 extends around large-diameter pulley 100 and a small-diameter pulley 104 that is coupled to and rotates shaft extension 106 together with rear roller 40, thereby driving tread belts 34 to rotate about their respective treadle assemblies 14, 16 at substantially the same speed.

It will be appreciated that the step-up gearing provided by step-up gearing mechanism 91 can be implemented in alternative ways. For example, cogs and endless chains can be substituted for pulleys and endless belts, and vice versa. Also, direct gear-to-gear engagement could be used as an alternative to any belts or chains.

As described above, each treadle assembly 14, 16 moves from an upward position to a downward position during a downward stroke. In a full downward treadle stroke a treadle assembly 14, 16 moves from a maximum height or pivot angle to a minimum height or pivot angle. For a user to maintain a foot on the tread belt 34 of each treadle assembly 14, 16 throughout the full downward treadle stroke, exercise device 10 can be configured such that tread belts 34 move less than an entire length L (FIG. 1) of deck 32 during the full downward treadle stroke. In a preferred embodiment, a length of travel of each tread belt 34 during a full downward stroke can be less than about 90% of the length L. Thus, a user can experience a full downward stroke on each treadle assembly 14, 16 without concern for whether his or her feet will be driven off the tread belts 34.

Of course, it should be understood that exercise device 10 can be operated with less than full upward or downward strokes. Another benefit of driving the tread belts 34 with the pivoting of the treadle assemblies 14, 16 is that a user may perform smaller, less-than-full-stroke pivoting (i.e., stepping) movements, and the tread belts 34 will move a correspondingly smaller distance. Thus, a user can adjust his or her stride on the exercise device 10 by adjusting the size of the downward strokes on treadle assemblies 14, 16. For example, the user may operate the exercise device 10 at 50% of the downward stroke and obtain movement of tread belts 34 of about 50% of the maximum tread belt travel distance. In one embodiment, each treadle assembly 14, 16 is configured to pivot a total of between about 6 and 20 degrees, and more preferably, a total of between about 10 and 14 degrees during each full treadle stroke. In addition, as noted above, the motion of the tread belts can directly correspond to an amount of drop of the downward stroke.

As shown in FIGS. 3 and 4, one implementation includes a weighted flywheel 108 that is secured to an outwardly extending region of rear roller 40 to increase its moment of inertia and to provide improved smoothness in the rotation of the tread belts 34. It will be appreciated that weighted flywheel 108 is optional and could be omitted from exercise device 10 in alternative implementations.

Rearward roller 40 extends through a pair of external ring bearings 110 that are mounted to and extend back from the inner, facing rearward sides of treadle assemblies 14, 16, thereby to support the inner, facing rearward sides of treadle assemblies 14, 16 on roller 40 while allowing it to rotate freely. An annular spacer 112 is provided between external bearings 110 to maintain a desired separation between them and treadle assemblies 14, 16. The combination of external bearings 110 and spacer 112 can further improve the structural rigidity of the forward-cantilevered treadle assemblies 14, 16 by reducing relative movement of the treadle assemblies 14, 16 along the axis of roller 40.

Referring again to FIG. 1, a left pedal member 111 and right pedal member 113 can be provided. Pedal members 111, 113 provide a stable, non-moving surface onto which a user can step or stand when mounting or dismounting exercise device 10. Pedal members 111, 113 are fixed in place on treadle assemblies 14, 16 and do not move longitudinally with tread belts 34. Accordingly, a user can optionally utilize exercise device 10 as a stepping device, instead of as a combination treadmill and stepping device, by exercising with his or her feet on pedal members 111, 113.

Figure 9:
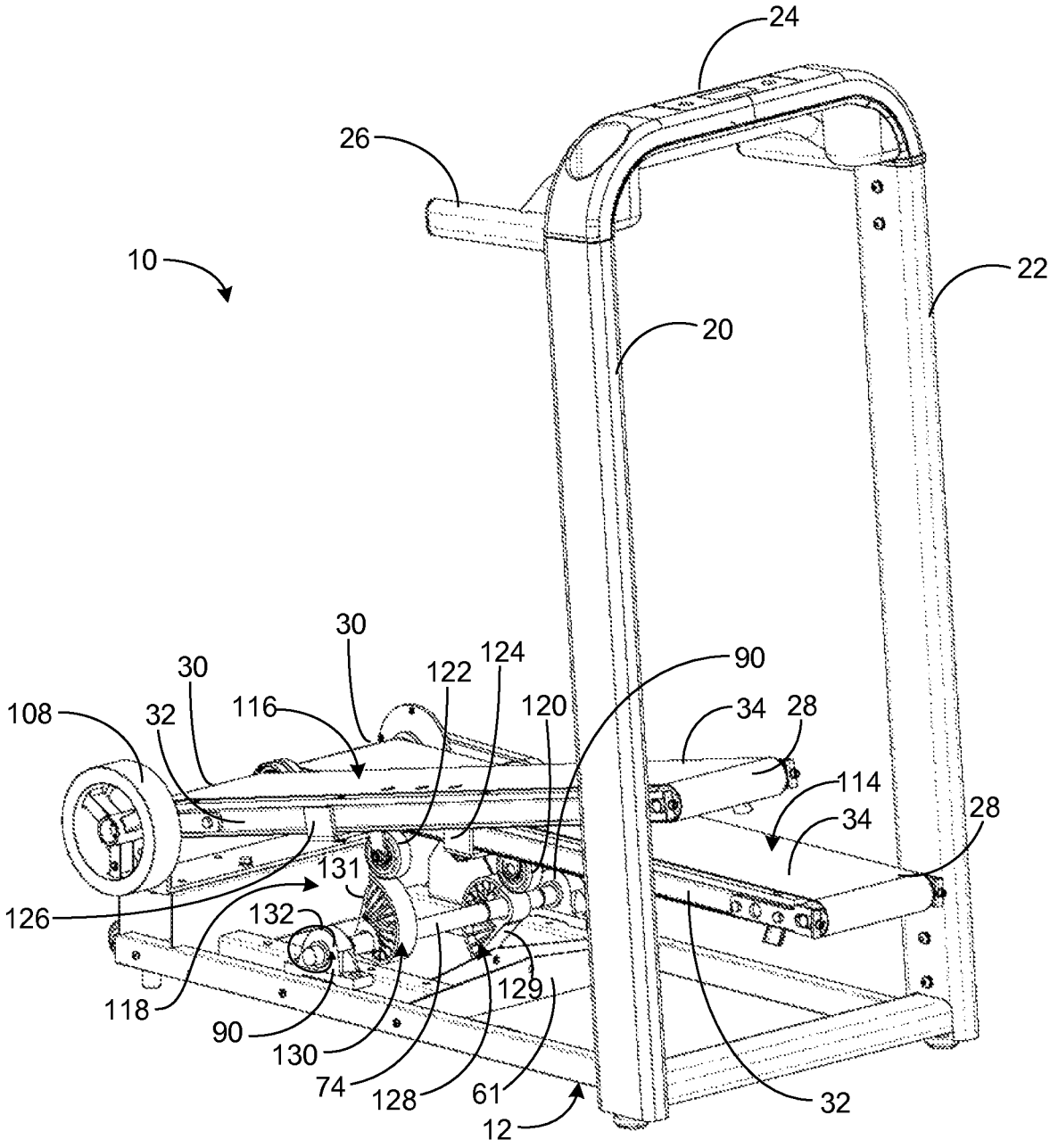
FIG. 9 is a perspective view of another embodiment of an exercise device.
Figure 10:
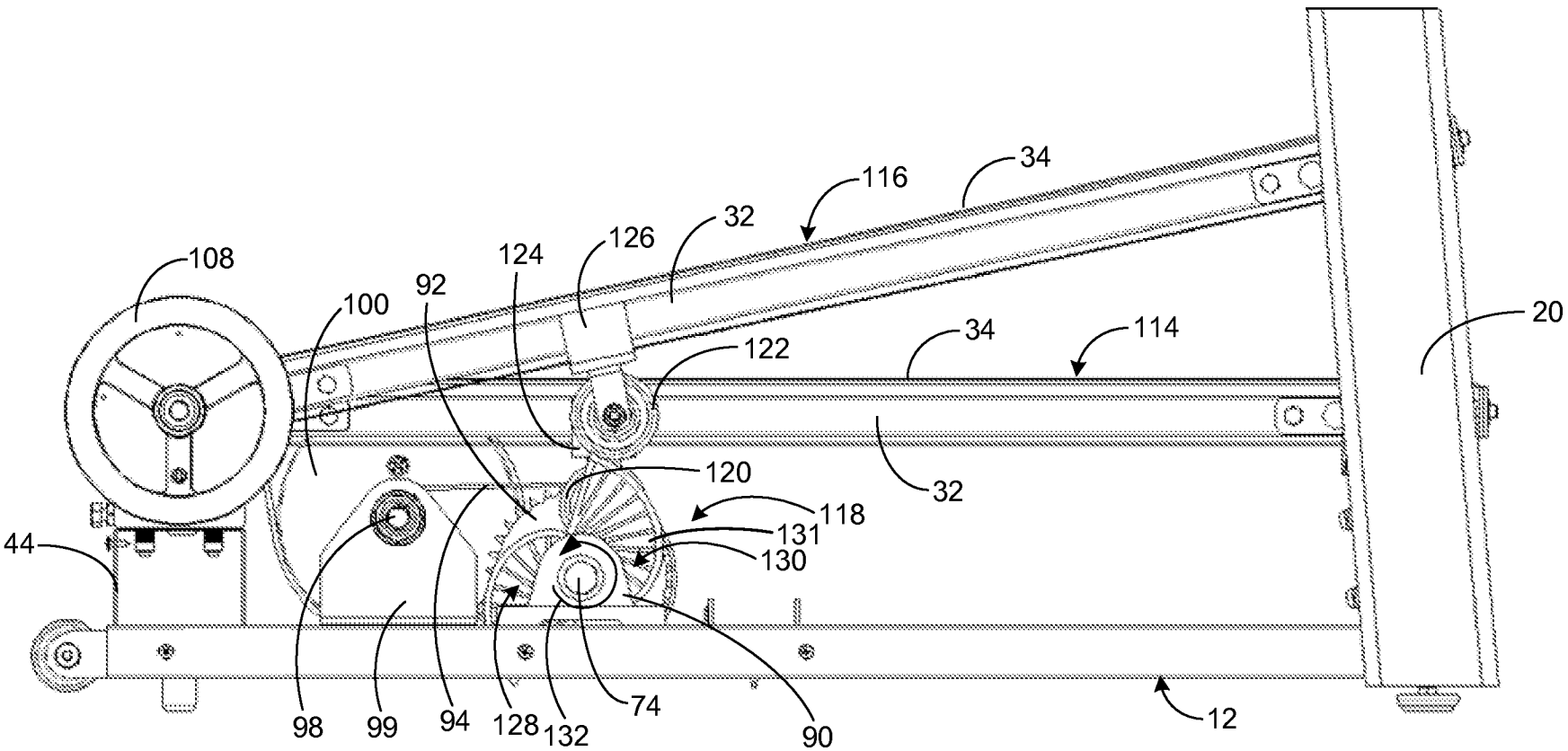
FIG. 10 is a side view of a rear portion of the exercise device of FIG. 9, shown with various elements removed for clarity.
Figure 11:
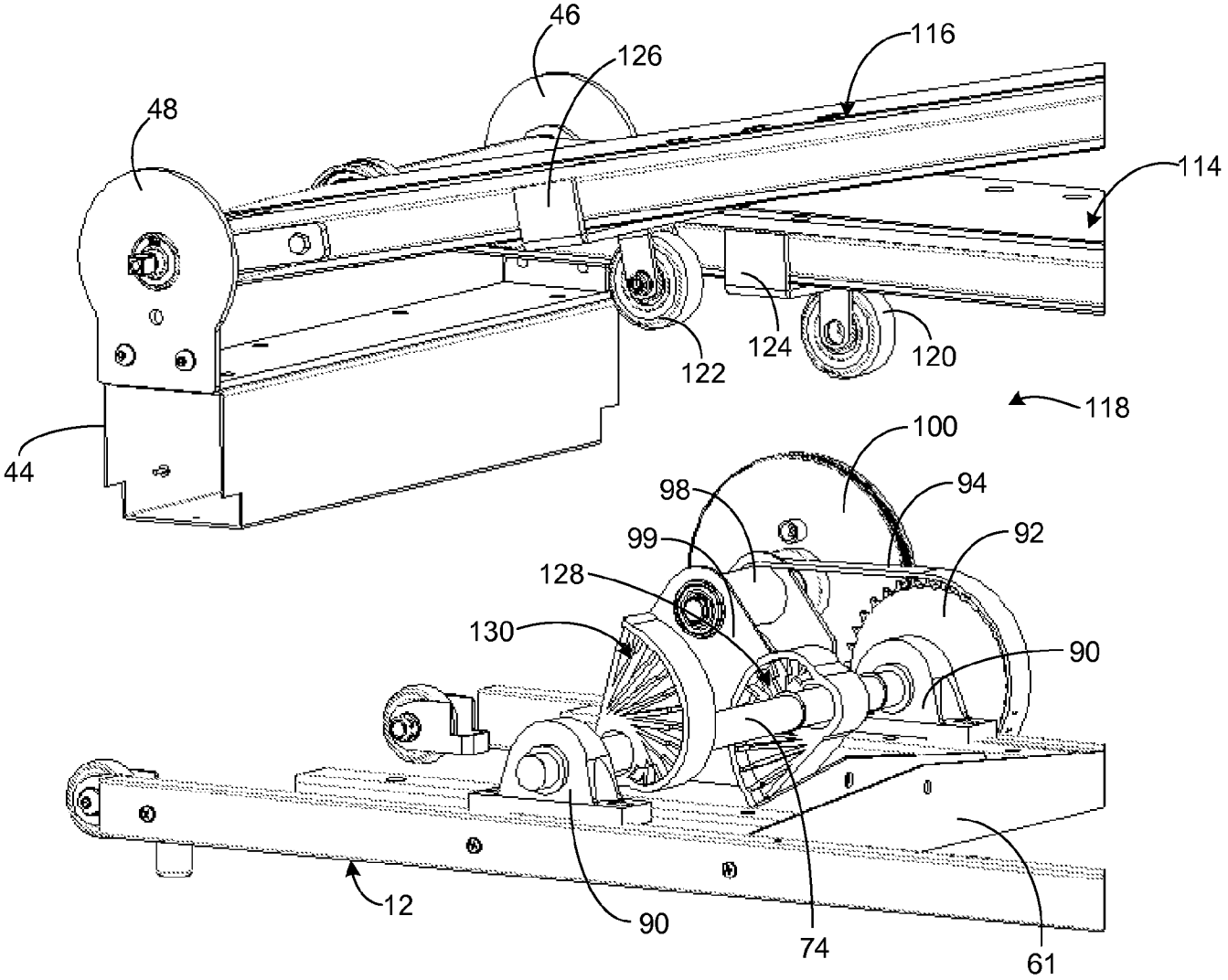
FIG. 11 is an exploded perspective view of a portion of the exercise device of FIG. 9, shown with various elements removed for clarity.

FIGS. 9-11 illustrate as another embodiment a cam-follower one-way drive system 118 that can be used with exercise device 10 in substitution for one-way drive system 75.

As shown in FIG. 9, a roller drive member 120 is mounted on a bracket member 124 that extends across and underneath left treadle assembly 114, and a roller drive member 122 is mounted on a bracket member 126 that extends across and underneath right treadle assembly 116. As with bracket members 80, 82 (FIG. 7), bracket members 124, 126 are attached to the sides of respective treadle assemblies 114, 116 so as not to interfere with the return motion of tread belts 34.

A lower portion of first drive member 120 is coupled to a first one-way engagement member 128 and a lower portion of second drive member 122 is coupled to a second one-way engagement member 130. In the illustrated embodiment of FIGS. 9-11, one-way engagement members 128, 130 include respective cam members 129, 131, each carried on drive shaft 74 by a one-way clutch bearing (not shown) having a heavy-duty torsional return spring (not shown). Like first and second one-way engagement members 84, 86, first and second one-way engagement members 128, 130 are capable of engaging and disengaging from drive shaft 74. During the downward stroke of each respective treadle assembly, first and second one-way engagement members 128, 130 engage with drive shaft 74 and transmit a force to drive shaft 74 causing it to rotate in a first direction 132. The upward stroke of each treadle assembly 114, 116 occurs when the user raises his or her foot above or otherwise steps from the treadle assembly, which allows the heavy-duty torsional spring attached to the corresponding cam member 129, 131 to rotate back opposite rotational direction 132 and to lift the treadle assembly. During the upward stroke of each treadle assembly the first and second one-way engagement members 128, 130 disengage with drive shaft 74 so that movement of cam members 129, 131 do not cause drive shaft 74 to rotate in a direction opposite that of first direction 132.

Rotation of drive shaft 74 is converted into a rotational force that is applied to shaft extension 106 in the same general manner as described above with respect to FIGS. 1-8. Thus, in the same general manner as that described above with respect to the one-way drive system described with respect to FIGS. 5 and 7, for example, the one-way drive system illustrated in FIGS. 9-11 converts a downward force applied during a downward stroke of each treadle assembly into a rotational force to cause tread belts 34 to rotate about their respective decks 32.

As described above with respect to FIGS. 5 and 7, one-way engagement members 84, 86 are coupled to the respective treadle assemblies and during the upward stroke they freewheel or slip relative to drive shaft 74 and return with their respective treadle assembly to a raised position. One-way engagement members 128, 130 can return with their respective treadle assembly to a raised position in a similar manner. For example, one-way engagement members 128, 130 can be directly or indirectly linked or coupled to drive members 120, 122 in any manner effective to cause one-way engagement members 128, 130 to move upwards with drive members 120, 122 during an upward stroke. Alternatively, a return force can be applied to one-way engagement members 128, 130 apart from drive members 120, 122 or the treadle assemblies 114, 116 themselves. For example, a spring member or other such biasing mechanism can be provided to exert a force on the one-way engagement members 128, 130 during the upward stroke. Since during an upward stroke, treadle assemblies 114, 116 do not exert any downward force on one-way engagement members 128, 130, a relatively small force exerted on one-way engagement members 128, 130 by a spring member (or other biasing member) can be sufficient to return one-way engagement members 128, 130 to a raised position in anticipation of the next downward stroke of the treadle assembly.

The use of a cam-follower system as described above can advantageously reduce stress on the system, relative to the linkage arm coupled to a pivoting one-way clutch bearing, by providing a more constant application of torque to drive shaft 74.

As discussed above, various return members can be provided. Also, if desired, one or more resistance elements can be provided to increase a resistance to the pivoting of the device. Such resistance elements can include any type of device, structure, member, assembly, and configuration that resists the pivotal movement of the treadle assemblies or the rotational movement of the tread belts. The resistance provided by the resistance element may be constant, variable, and/or adjustable. Moreover, the resistance may be a function of load, of time, of heat, or of other factors. Such a resistance element may provide other functions, such as dampening the downward, upward, or both movements of the treadle assemblies. The resistance element can also impart a return force on the treadles such that if the treadle is in a lower position, the resistance element will impart a return force to move the treadle upward, or if the treadle is in an upper position, the resistance element will impart a return force to move the treadle downward. The term "shock" or "dampening element" can be used to refer to a resistance element, or to a spring (return force) element, or a dampening element that may or may not include a spring (return) force.

In addition, various resistance members can be provided to increase the resistance of the rotation of the tread belts around their respective deck member. For example, a friction brake, such as a felt pad, can be provided to resist rotational movement of the tread belts. Alternatively, the resistance member can comprise an eddy current brake, which creates a magnetic field to increase a resistance to the rotational movement of tread belts over their respective decks.

Figure 12:
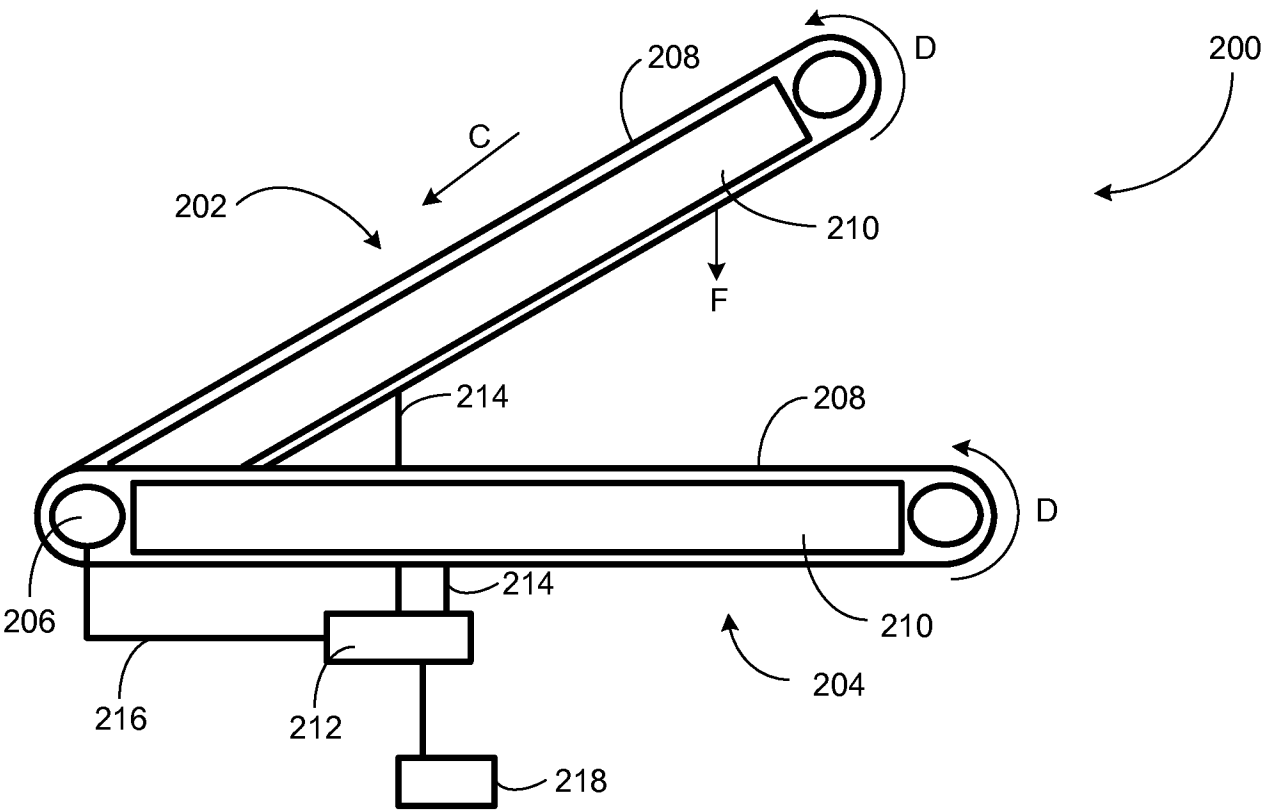
FIG. 12 is a schematic view of an exercise device that comprises pivotable treadle assemblies with rotatable tread belts that can be driven by downward movement of the respective treadle assemblies.

FIG. 12 illustrates a schematic view of a motorless exercise device 200 that includes a pair of treadle assemblies 202, 204. Both treadle assemblies 202, 204 are pivotably mounted to a frame (such as the frames disclosed herein) so that each treadle assembly pivots upwards and downwards about a common pivot axis 206. Each treadle assembly includes a tread belt 208 that rotates in a continuous circuit about a deck 210, which provides a supporting surface for the tread belts 208. Each tread belt 208 rotates about its respective deck 210 in a first direction D, such that, in operation, a surface of each tread belt 208 moves from a front portion of its respective treadle assembly 202, 204 to a rear portion of its respective treadle assembly to simulate a walking, jogging, or running movement.

FIG. 12 illustrates treadle assembly 202 in an upward position and treadle assembly 204 in a downward position. The forces exerted by a user on the treadle assemblies are described below with reference to treadle assembly 202; however, it should be understood that both treadle assemblies operate in the same general manner. In operation, a user places a first foot on a front portion of treadle assembly 202, thereby exerting a downward force F on the treadle assembly 202. Each treadle assembly 202, 204 is coupled to a one-way drive system 212 that is positioned generally below treadle assemblies 202, 204. Treadle assemblies 202, 204 are coupled to the drive system 212 in any manner sufficient to transmit force F to drive system 212. FIG. 12 illustrates a coupling system 214. As described herein, the coupling system 214 can comprise any linkage members or other such structures that directly or indirectly contact the drive system 212 to transmit the downward directed force F from the treadle assemblies 202, 204 to the drive system 212.

In this manner, the gravity-driven, user-directed downward force F delivers energy to power the one-way drive system 212, which transfers at least a portion of that energy to drive the rotation of tread belts 208 of both treadle assemblies 202, 204. Thus, the potential energy associated with a user supported, at least in part, on a treadle assembly in an upward position can be transmitted into rotational energy sufficient to drive the tread belts of both treadle assemblies. Drive system 212 is operatively coupled (e.g., via a rotational coupling) to tread belts 208 to transmit the potential energy of the user into rotational energy sufficient to drive tread belts 208. The operative coupling of drive system 212 to tread belts 208 is illustrated schematically as a rotational coupling member 216 in FIG. 12.

Since each tread belt 208 is rotatable about its respective deck 210, depending on the angle of each respective treadle assembly, a component C of the downward directed force F is also be directed towards a rear portion of each treadle assembly, further facilitating the rotation of tread belts 208 in the first direction D. Thus, in some embodiments, exercise device 200 is driven by both the drive system 212 as it converts potential energy from the user into rotational energy delivered to tread belts 208 and the component C of the downward directed force which also causes tread belts 208 to rotate about their respective decks 210.

In another embodiment, exercise device 200 includes a resistance member 218. Resistance member 218 can include a power generator that is configured to capture energy from the system and store and/or use the energy produced by operation of the exercise device. Alternatively, resistance member 218 may be a user-controlled braking system, as is known in the art, by which the user may control the rotational motion of tread belts 208 relative to pivotal motion of treadle assemblies 202, 204.

In view of the many possible embodiments to which the principles of the disclosed embodiments may be applied, it should be recognized that the illustrated embodiments are only preferred examples and should not be taken as limiting the scope of the invention. Rather, the scope of the invention is defined by the following claims. We therefore claim as our invention all that comes within the scope and spirit of these claims.

We claim:

1. An exercise device comprising:

a frame;

first and second treadle assemblies, each treadle assembly including a deck, an endless tread belt rotatably mounted to pass over the deck, each treadle assembly being pivotably mounted to the frame to pivot between upward and downward positions;

a drive shaft operably coupled to the first and second treadle assemblies by a one-way drive system through which pivotal motion of the first and second treadle assemblies provides rotational motion to the drive shaft; and a rotational coupling between the drive shaft and the tread belts so that the rotational motion of the drive shaft provides rotational motion of the tread belts, wherein the one-way drive system comprises a first downwardly-extending drive member coupled to the first treadle assembly and positioned beneath the first treadle assembly to engage with a first one-way engagement member to rotate the drive shaft in a first direction when the first treadle assembly moves between the upward and downward positions, and a second downwardly-extending drive member coupled to the second treadle assembly and positioned beneath the second treadle assembly to engage a second one-way engagement member to rotate the drive shaft in the first direction when the second treadle assembly moves between the upward and downward positions.

2. The exercise device of claim 1, wherein the first and second engagement members are configured to disengage from the drive shaft when the respective first and second treadle assemblies return from movement that rotates the drive shaft in the first direction.

3. The exercise device of claim 1, wherein the first drive member includes a first linkage arm and the first engagement member includes a first one-way clutch bearing coupled to the first linkage arm, and the second drive member includes a second linkage arm and the second engagement member includes a second one-way clutch bearing coupled to the second linkage arm.

4. The exercise device of claim 1, wherein the first drive member includes a first roller and the first engagement member includes a first cam that is driven by the first roller, and the second drive member includes a second roller and the second engagement member includes a second cam that is driven by the second roller.

5. The exercise device of claim 4, wherein both first and second cams are mounted on respective one-way clutch bearings, and the first and second cams pivot back toward the respective first and second rollers during movement of the respective first and second treadle assemblies from the downward position to the upward position.

6. The exercise device of claim 1, in which the rotational coupling between the drive shaft and the tread belts includes a roller shaft extending across a back portion of the first and second treadle assemblies to drive rotational motion of the tread belts of the first and second treadle assemblies.

7. The exercise device of claim 6, wherein the rotational coupling includes a step-up gearing mechanism to provide stepped-up gearing between rotational motion of the drive shaft and the roller shaft.

8. The exercise device of claim 1, further comprising a return assembly that links the first and second treadle assemblies such that movement of either of the first and second treadle assemblies from the upward position to the downward position causes the other of the first and second treadle assemblies to move from the downward position to the upward position.

9. The exercise device of claim 1, wherein the decks of the first and second treadle assemblies each have a length and the first and second treadle assemblies are pivotable between a maximum pivot angle and a minimum pivot angle, and movement of either treadle assembly between the maximum pivot angle and the minimum pivot angle moves a point on the tread belts of the first and second treadle assemblies a distance that is less than the length of the decks.

10. An exercise device comprising:

a frame;

a left treadle assembly having a left deck and an endless left tread belt rotatably mounted to pass over the left deck, the left treadle assembly being pivotally mounted to the frame;

a right treadle assembly having a right deck and an endless right tread belt rotatably mounted to pass over the right deck, the right treadle assembly being pivotally mounted to the frame;

a roller extending across a rear portion of both the left and right treadle assemblies and engaging the left and right tread belts to rotate them; and a motorless drive system configured to drive the roller during pivotal motion of the left and right treadle assemblies, the motorless drive system including a drive shaft positioned below the left and right treadle assemblies and a rotational coupling between the drive shaft and the roller extending across the rear portion of both the left and right treadle assemblies, wherein the motorless drive system further includes a left drive member and a right drive member, the left drive member being coupled to and extending below the left treadle assembly, the right drive member being coupled to and extending below the right treadle assembly, the left and right drive members engaging the drive shaft during pivotal motion of the left and right treadle assemblies to provide to the drive shaft rotational motion that is imparted to the roller via the rotational coupling.

11. The exercise device of claim 10, wherein the left and right treadle assemblies are pivotable between an upward position and a downward position to provide a downward stroke, and the motorless drive system is powered by the downward movement of the left and right treadle assemblies during their downward strokes.

12. The exercise device of claim 10, wherein the roller drives the right and left tread belts at the same speed.

13. The exercise device of claim 10, further comprising a pair of external bearing members positioned on the roller between the left and right treadle assemblies.

14. The exercise device of claim 10, further comprising a return assembly that links the left and right treadle assemblies such that the left and right treadle assemblies move in opposite pivotal directions and the left and right drive members alternately drive the drive shaft.

15. The exercise device of claim 10, wherein the left and right drive members comprise linkage arms.

16. The exercise device of claim 10, wherein the left and right drive members comprise rollers.

17. The exercise device of claim 10, further comprising a left one-way clutch bearing and a right one-way clutch bearing, wherein the left drive member provides a downward force on the left one-way clutch bearing to engage the drive shaft during a downward stroke of the left treadle assembly and the right drive member provides a downward force on the right one-way clutch bearing to engage the drive shaft during a downward stroke of the right treadle assembly.

18. An exercise device comprising:

a frame;

first and second treadle assemblies, each treadle assembly including a length and a deck and an endless tread belt passing over the deck, each treadle assembly being pivotably mounted to the frame such that each treadle assembly can alternately pivot upwards and downwards; and a motorless drive system that is driven by the respective downward movements of the first and second treadle assemblies from upward positions to downward positions to rotate the tread belts around the treadle assemblies, wherein the motorless drive system includes a first one-way drive member associated with the first treadle assembly and a second one-way drive member associated with the second treadle assembly, the first and second one-way drive members alternately engaging with a drive shaft to simultaneously rotate the tread belts of the first and second treadle assemblies.

19. The exercise device of claim 18, further comprising a return assembly that links the left and right treadle assemblies such the left and right treadle assemblies move in alternating directions.

20. The exercise device of claim 19, further comprising a rotational coupling between the drive shaft and the tread belts so that the rotational motion of the drive shaft provides rotational motion of the tread belts, wherein the first and second one-way drive members engage the drive shaft to rotate it and thereby to provide rotation to the tread belts via the rotational coupling.

* * * * *